US006176171B1

(12) United States Patent
Sparks

(10) Patent No.: US 6,176,171 B1
(45) Date of Patent: Jan. 23, 2001

(54) FUEL INJECTION PUMP WITH PRECIPITATE INHIBITING FEATURES

(75) Inventor: James D. Sparks, Edelstein, IL (US)

(73) Assignee: Caterpillar Inc., Peoria, IL (US)

( * ) Notice: Under 35 U.S.C. 154(b), the term of this patent shall be extended for 0 days.

(21) Appl. No.: 08/979,577

(22) Filed: Nov. 26, 1997

(51) Int. Cl.[7] ..... F01B 31/00
(52) U.S. Cl. ..... 92/86.5; 92/87
(58) Field of Search ..... 92/86.5, 87

(56) References Cited

U.S. PATENT DOCUMENTS

| | | | | |
|---|---|---|---|---|
| 4,826,081 | | 5/1989 | Zwick | 239/91 |
| 4,963,077 | * | 10/1990 | Besic | 417/437 |
| 5,337,651 | * | 8/1994 | Gardiner | 92/87 |
| 5,431,957 | * | 7/1995 | Gardiner | 427/248.1 |

FOREIGN PATENT DOCUMENTS

| | | | | |
|---|---|---|---|---|
| 2123492A | | 2/1984 | (GB) | F02M/59/44 |
| 641153 | * | 8/1979 | (SU) | 92/86.5 |

OTHER PUBLICATIONS

US Patent Appl No. 08/762,504, Method and Apparatus For Injecting Fuel Using Control Fluid to Control the Injection's Pressure and Time US Pat 5826501.
Patent Abstracts of Japan, vol. 009, No. 098 (M–375), Apr. 27, 1985 & JP 59 221459 A (Mitsubishi Jukogyo KK), Dec. 13, 1984.

* cited by examiner

*Primary Examiner*—Timothy S. Thorpe
*Assistant Examiner*—Ehud Gartenberg
(74) *Attorney, Agent, or Firm*—Michael B. McNeil

(57) ABSTRACT

A fuel injection pump with precipitate inhibiting features includes a pump body that defines a flushing fluid inlet and a flushing fluid outlet that open into a plunger bore. A plunger is positioned in the plunger bore and is moveable between a retracted position and an advanced position. The plunger has a first end separated from a second end by a side surface. A portion of the side surface and the plunger bore define a flush connection passage that connects the flushing fluid inlet to the flushing fluid outlet over a portion of the plunger's movement between its retracted position and its advanced position.

20 Claims, 4 Drawing Sheets

FUEL INJECTION PUMP WITH PRECIPITATE INHIBITING FEATURES

TECHNICAL FIELD

The present invention relates generally to lubricated pumps, and more particularly to heavy diesel fuel injection pumps having precipitate inhibiting features.

BACKGROUND ART

In one class of liquid pumps, a pump body defines a plunger bore within which a plunger reciprocates with each pumping stroke of the device. In order to prevent the plunger from sticking or seizing, a lubricant, such as lubricating oil, must often be employed. In some cases, such as heavy diesel fuel injection pumps, the lubricant itself can sometimes be a source of plungers sticking and seizures due to the formation of precipitates where the lubricating oil comes in contact with the heavy diesel fuel. One such precipitate includes the build-up of calcium carbonate in a plunger bore where heavy diesel fuel has migrated up the side of the plunger into contact with the lubricating oil.

The present invention is directed to overcoming these and other problems associated with the formation of precipitates in lubricated pumps, especially heavy diesel fuel injection pumps.

DISCLOSURE OF THE INVENTION

In one embodiment, a pump with precipitate inhibiting features includes a pump body that defines a flushing fluid inlet and a flushing fluid outlet that open into a plunger bore. A plunger is positioned in the plunger bore and moveable between a retracted position and an advanced position. The plunger has a first end separated from a second end by a side surface. A portion of the plunger's side surface and the plunger bore define a flush connection passage that connects the flushing inlet to the flushing fluid outlet over a portion of the plunger's movement between its retracted position and its advanced position.

In another embodiment of the present invention, a fuel injection pump with precipitate inhibiting features includes a pump body that defines a flushing fluid inlet and a flushing fluid outlet that open into a plunger bore. A plunger is positioned in the plunger bore and moveable between a retracted position and an advanced position. The plunger has a first end separated from a second end by a side surface. A portion of the plunger's side surface and the plunger bore define a flush connection passage that connects the flushing fluid inlet to the flushing fluid outlet over part of the plunger's movement between its retracted position and its advanced position. A different portion of the plunger's side surface blocks the flushing fluid inlet from the flushing fluid outlet over a different part of the plunger's movement between its retracted position and its advanced position. A portion of the plunger bore and a portion of the plunger adjacent its first end define a fuel pressurization chamber. The first end of the plunger is attached to a tappet.

In still another embodiment, a fuel injection pump with precipitate inhibiting features includes a pump body that defines a flushing fluid inlet and a flushing fluid outlet that open into a plunger bore. The plunger is positioned in the plunger bore and moveable between a retracted position and an advanced position. The plunger has a first end, which is exposed to lubricating oil, that is separated from a second end, which is exposed to heavy diesel fuel, by a side surface. A portion of the side surface and the plunger bore define a flush connection passage that connects the flushing fluid inlet to the flushing fluid outlet over part of the plunger's movement between its retracted position and its advanced position. A different portion of the plunger's side surface blocks the flushing fluid inlet from the flushing fluid outlet over a different part of the plunger's movement between its retracted position and its advanced position. The flushing fluid inlet is connected to a source of flushing fluid that is different from lubricating oil and heavy diesel fuel.

BEST MODE FOR CARRYING OUT THE INVENTION

Figure 1:
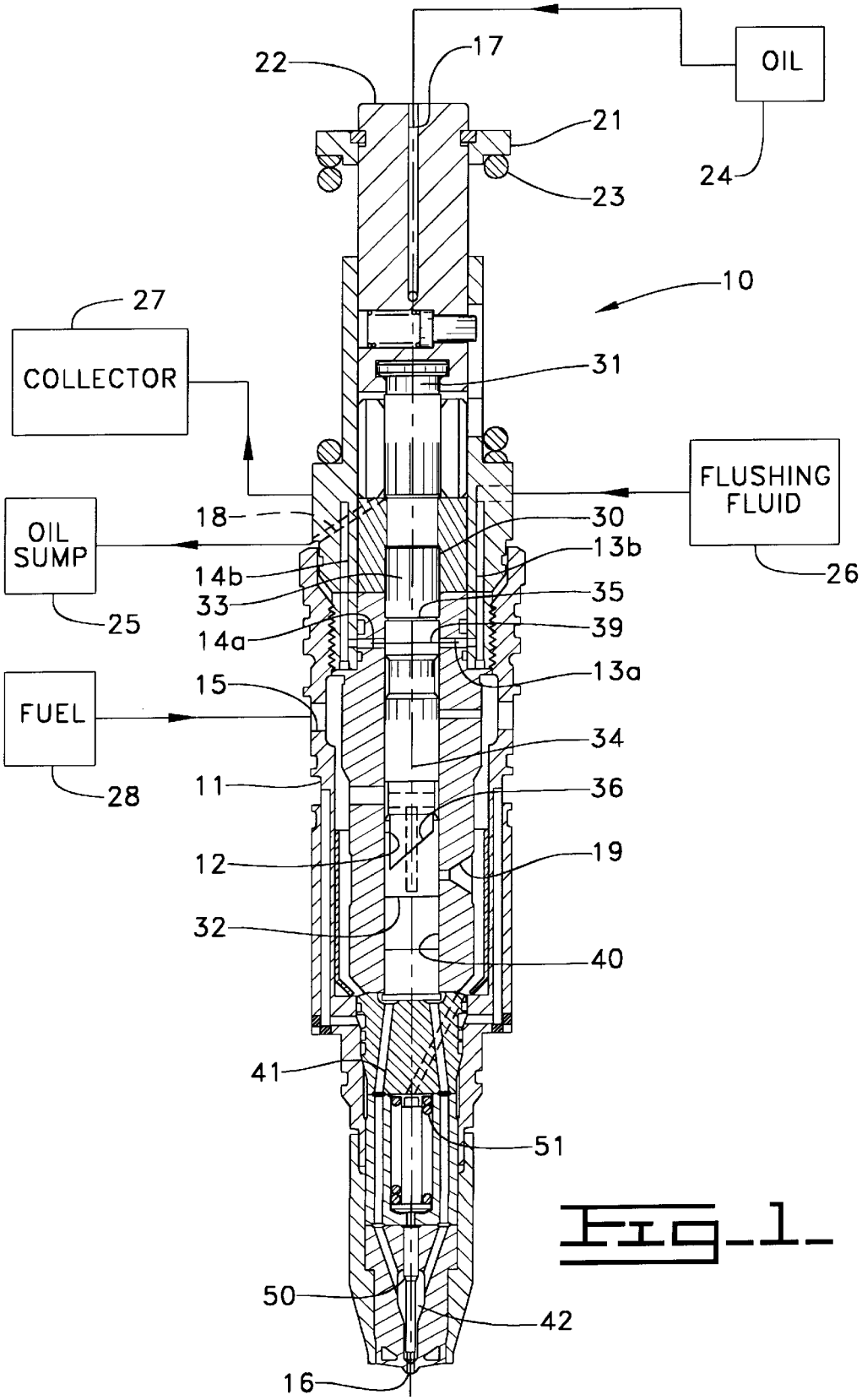
FIG. 1 is a sectioned side elevational view of a heavy diesel fuel injector according to the present invention.
Figure 2:
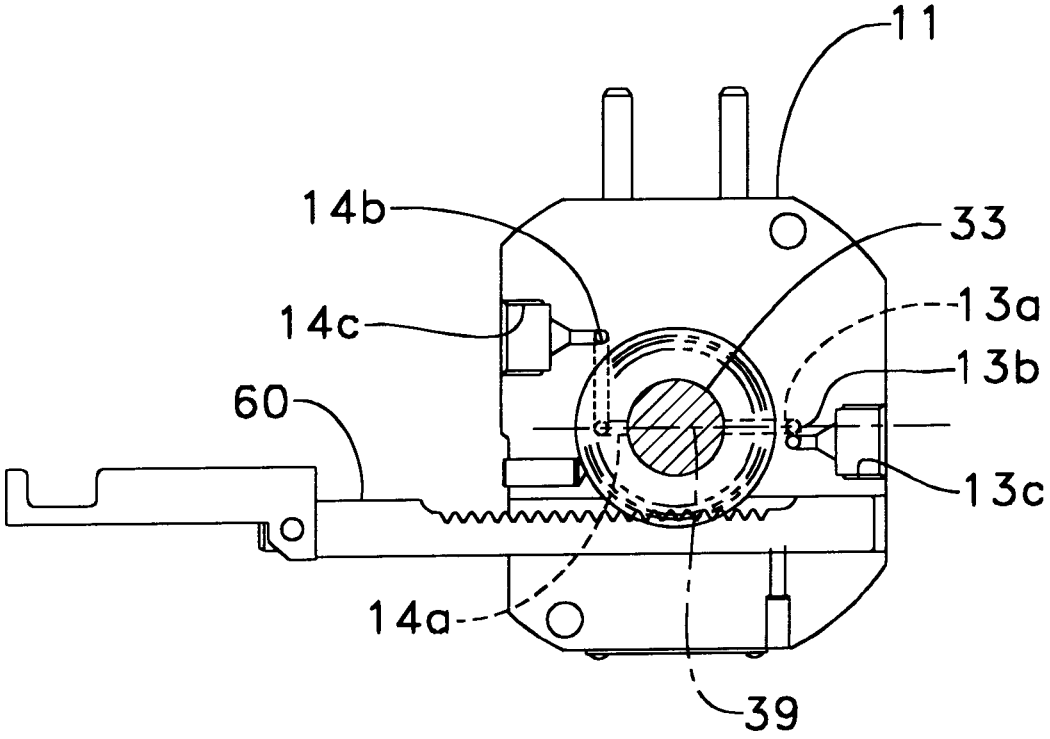
FIG. 2 is a top sectioned view of the fuel injector of FIG. 1 as viewed along section lines b—b.

Referring now to FIGS. 1 and 2, heavy diesel fuel injector 10 includes a pump body 11 that defines a plunger bore 12. A flushing fluid inlet 13*a–c* opens on one end out of pump body 11 and on its other end into plunger bore 12. Similarly, a flushing fluid outlet 14*a–c* opens on one end out of pump body 11 and on its other end into plunger bore 12. When installed in an engine, flushing fluid inlet portion 13*c* is connected to a source of slightly pressurized flushing fluid 26, and flushing fluid outlet portion 14*c* is connected to a low pressure collection container 27. Thus, a slight pressure gradient exists from flushing fluid inlet 13 to flushing fluid outlet 14 such that fluid will flow between the two when they are placed in fluid communication with one another. In the preferred embodiment, the flushing fluid is preferably a distillate oil, such as light diesel fuel, kerosene, jet fuel or the like. Preferably, the flushing fluid has some lubricating properties, and is a solvent for both engine lubricating oil and heavy diesel fuel. Preferably the flushing fluid is arranged in an open circuit such that the flushing fluid passes through only once and is not recirculated. In some instances it may be desirable to mix the used flushing fluid with the heavy diesel fuel for subsequent injection and combustion in the engine.

Injector pump body 11 also defines a heavy diesel fuel inlet 15 connected to a source of heavy diesel fuel 28 and a nozzle outlet 16. A plunger 30 is positioned in plunger bore 12 and is moveable between a retracted position, as shown, and an advanced position with each pumping cycle of fuel injector 10. Plunger 30 includes a first end 31 separated from a second end 32 by a side surface 33. Plunger 30 moves along plunger centerline 34 and has a generally cylindrical shape. A portion of plunger 30 adjacent second end 32 and a portion of plunger bore 12 define a fuel pressurization chamber 40 that is in fluid communication with a nozzle chamber 42 via a nozzle connection passage 41. A needle valve member 50 is positioned in pump body 11 and is moveable between an inject position in which nozzle chamber 42 is open to nozzle outlet 16, and a closed position in which nozzle chamber 42 is blocked to nozzle outlet 16. Needle valve member 50 is biased toward its closed position by a needle return spring 51. As in a conventional fuel injector, an amount of fuel enters pump body 11 when plunger 30 is undergoing its return up stroke, and an amount of fuel is pumped out of nozzle outlet 16 with each downward pumping stroke of plunger 30.

The amount of fuel leaving nozzle outlet 16 with each pumping stroke of plunger 30 is determined by the orientation of helical fuel spill slot 36 with regard to fuel spill passage 19. This angular orientation is controlled by a fuel metering rack and pinion device 60 in a convention manner.

The first end 31 of plunger 30 is attached to tappet 21. Tappet 21 includes a rocker arm contact surface that defines a lubricating oil inlet 17 that is connected to a source of lubricating oil 24. In order to maintain plunger 30 appropriately lubricated, engine lubricating oil enters at lubricating oil inlet 17 and circulates around first end 31 of plunger 30 and eventually leaks back out of pump body 11 through lubricating oil outlet 18, where it eventually returns to the engine lubricating oil sump 25 in a conventional manner. Both tappet 21 and plunger 30 are retracted between injection events by a tappet return spring 23.

Apart from its other features, plunger 30 includes a flush connection annulus 35 that connects flushing fluid inlet portion 13*a* to flushing fluid outlet portion 14*a* twice per pumping cycle, once during the downward stroke and once during the upward stroke of plunger 30. Preferably, flushing fluid inlet portion 13*a* and flushing fluid outlet portion 14*a* share a common centerline 39 that intersects plunger centerline 34. With this orientation, the fluid passageway around plunger 30 on one side of annulus 35 is about equal to fluid flow passage around the other side of the plunger. This insures that both sides of plunger 30 are adequately flushed each time flush connection annulus 35 connects flushing fluid inlet 13 to flushing fluid outlet 14.

Industrial Applicability

Figure 3A:
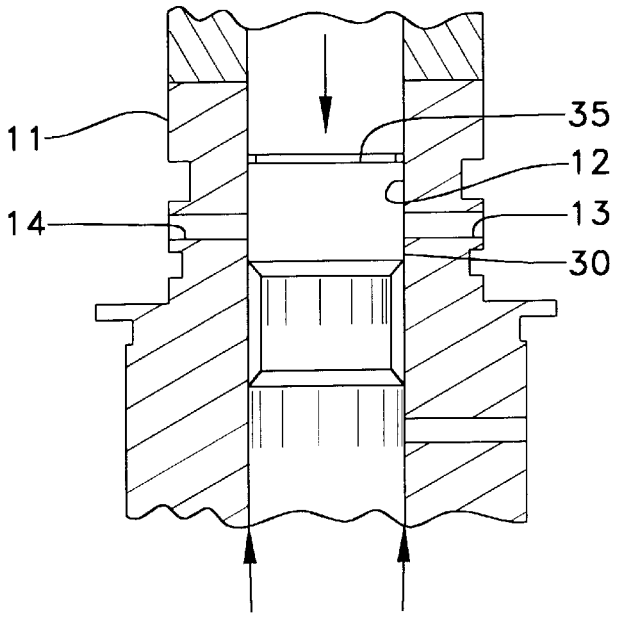
FIGS. 3*a–d* are a schematic sequence of one pumping cycle of a pump employing the precipitate inhibiting features of the present invention.
Figure 3B:
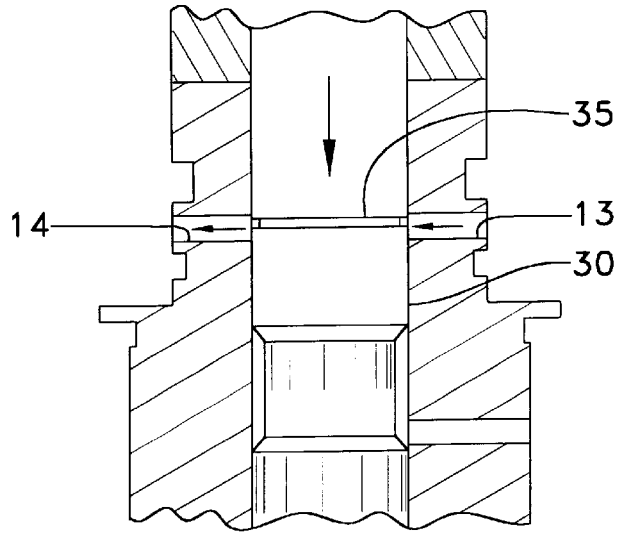
Figure 3C:
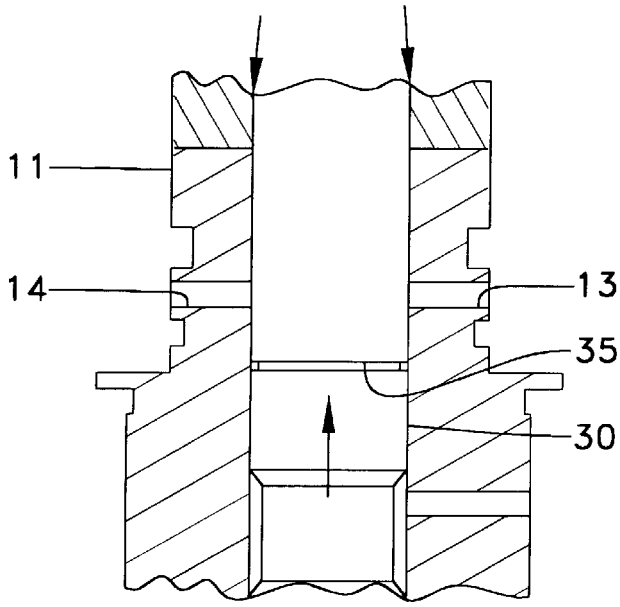
Figure 3D:
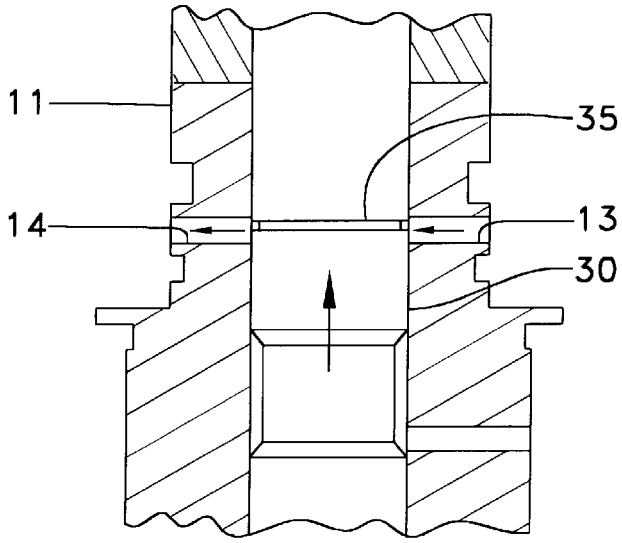

Referring now in addition to FIGS. 3*a–d,* each injection event begins with tappet 21 being driven downward. As plunger 30 is driven downward as shown in FIG. 3*a,* fuel pressure rises rapidly in fuel pressurization chamber 40. Although there is a relatively tight clearance between plunger 30 and plunger bore 12, the extreme fuel pressures cause a small amount of heavy diesel fuel to migrate up the plunger bore along the side surface of the plunger. At this time, flushing fluid inlet 13 is blocked to flushing fluid outlet 14 by plunger 30. Although a small amount of the migrating heavy diesel fuel finds its way into flushing fluid inlet 13 and flushing fluid outlet 14, the majority of the same is believed to collect in flush connection annulus 35.

For a brief portion as plunger 30 continues its downward stroke, flush connection passage 35 connects flushing fluid inlet 13 of flushing fluid outlet 14, the pressure gradient existing between the inlet and the outlet causes an amount of the accumulated fluid in flush connection annulus 35 to move leftward into flushing fluid outlet 14. At the same time, a small amount of fresh flushing fluid enters into flush connection annulus 35.

After the injection event is ended and the plunger has reached the bottom of its stroke, it begins moving upward under the action of tappet return spring 23. This creates a negative pressure in fuel pressurization chamber 40 in order to draw in an amount of fuel for a subsequent injection event. This negative pressure also causes a small amount of lubricating oil on the top end of plunger 30 to migrate downward along the side surface of the plunger. A small amount of this migrating lubricating oil then finds its way into flush connection annulus 35. As plunger 30 continues its upward return stroke, flush connection annulus 35 again connects flushing fluid inlet 13 with flushing fluid outlet 14 so that another small amount of fresh flushing fluid is brought into the annulus and a small amount of flushing fluid contaminated with lubricating oil and/or heavy diesel fuel is carried away into flushing fluid outlet 14. Thus, flush connection annulus 35 not only acts as a barrier between the lubricating oil above and the heavy diesel fuel below, but it also serves as a means by which the interface between the two fluids is continuously flushed so that precipitates that could cause the sticking and seizures are inhibited from forming in the clearance area between plunger 30 and plunger bore 12. Only a relatively small amount of contaminated fluid need be flushed each cycle in order to prevent harmful precipitate formation and maintain adequate lubricity.

Those skilled in the art will appreciate that the present invention finds potential application in virtually any type of pump where two different liquids are present, and the two fluids have a potential for creating undesirable precipitates where they come in contact. Preferably, the present invention introduces a third fluid into the pumping system at a position that is a barrier between the two other fluids. The third fluid is preferably but need not necessarily be a solvent for the other two fluids and should be periodically flushed through the barrier area in order to inhibit the formation of precipitates that could otherwise cause sticking and seizures in the pump plunger. The present invention is preferably applicable in the case of heavy diesel fuel injection pumps since it is known that calcium carbonate precipitates can form where heavy diesel fuel comes in contact with engine lubricating oil. Since such pumps cannot properly be operated without lubrication and because some contact between the lubricating oil and the heavy diesel fuel will almost inevitably occur, the present invention periodically flushes the area where the two liquids could come in contact and form precipitates in order to prevent plunger sticking and seizures that might otherwise occur.

While the present invention has been illustrated as including a flushing inlet and outlet that share a common centerline that intersects with that of the plunger's centerline, and the connection passage between the inlet and the outlet is an annulus formed on the side surface of the plunger, those skilled in the art will appreciate that numerous other passage arrangements could be made without changing the essential flushing action produced by the present invention. In some instances, two or more annuluses in the side surface of the plunger may be desired. Furthermore, numerous other workable but more difficult to machine passage combinations could be employed without otherwise altering the performance of the present invention.

Those skilled in the art will appreciate the above description is intended for illustrative purposes only and is not intended to limit the scope of the present invention in any way. For instance, the concepts of the present invention could be incorporated into numerous different types of pumps employing a wide variety of different fluids without departing from the intended spirit and scope of the invention, which is defined in terms of the claims as set forth below.

What is claimed is:

1. A pump with precipitate inhibiting features comprising:

a pump body defining a flushing fluid inlet and a flushing fluid outlet that open into a plunger bore;

a plunger positioned in said plunger bore and being movable between a retracted position and an advanced position, and said plunger having a first end separated from a second end by a side surface;

a portion of said side surface and said plunger bore defining a flush connection passage that connects said flushing fluid inlet to said flushing fluid outlet over an intermediate portion of said plunger's movement between said retracted position and said advanced position; and said side surface blocking fluid communication between said flushing fluid inlet and said flushing fluid outlet over a different portion of said plunger's movement between said retracted position and said advanced position.

2. The pump of claim 1 wherein said first end is exposed to a lubricating oil;

said second end is exposed to a heavy diesel fuel; and said flushing fluid inlet is connected to a source of flushing fluid.

3. The pump of claim 2 wherein said flushing fluid is different from lubricating oil and heavy diesel fuel.

4. The pump of claim 3 wherein said flushing fluid is a distillate oil.

5. The pump of claim 1 wherein said side surface of said plunger blocks said flushing fluid inlet from said flushing fluid outlet over a majority of said plunger's movement between said retracted position and said advanced position.

6. The pump of claim 1 wherein a portion of said plunger bore and a portion of said plunger adjacent said second end define a fuel pressurization chamber; and said first end of said plunger being attached to a tappet.

7. The pump of claim 6 wherein said pump body defines a fuel outlet in fluid communication with said fuel pressurization chamber.

8. The pump of claim 7 wherein said fuel outlet is a nozzle; and a needle valve member positioned in said pump body and being movable between an inject position in which said nozzle is open and a closed position in which said nozzle is blocked.

9. The pump of claim 1 wherein at least one of said flushing fluid inlet, said flushing fluid outlet and said flush connection passage including at least one annulus formed in said side surface of said plunger.

10. The pump of claim 9 wherein said flush connection passage includes a single annulus formed in said side surface of said plunger.

11. The pump of claim 10 wherein said flushing fluid inlet and said flushing fluid outlet share a common centerline where they open to said plunger bore.

12. The pump of claim 11 wherein said plunger bore has a plunger centerline; and said common centerline intersects said plunger centerline.

13. A fuel injection pump with precipitate inhibiting features comprising:

a pump body defining a flushing fluid inlet and a flushing fluid outlet that open into a plunger bore;

a plunger positioned in said plunger bore and being movable between a retracted position and an advanced position, and said plunger having a first end separated from a second end by a side surface;

a portion of said side surface and said plunger bore defining a flush connection passage that connects said flushing fluid inlet to said flushing fluid outlet over an intermediate part of said plunger's movement between said retracted position and said advanced position;

a different portion of said side surface of said plunger blocking said flushing fluid inlet from said flushing fluid outlet over a beginning and ending part of said plunger's movement between said retracted position and said advanced position;

a portion of said plunger bore and a portion of said plunger adjacent said second end define a fuel pressurization chamber; and said first end of said plunger being attached to a tappet.

14. The fuel injection pump of claim 13 wherein at least one of said flushing fluid inlet, said flushing fluid outlet and said flush connection passage including at least one annulus formed in said side surface of said plunger.

15. The fuel injection pump of claim 14 wherein said first end is exposed to a lubricating oil;

said second end is exposed to a heavy diesel fuel; and said flushing fluid inlet is connected to a source of flushing fluid that is different from said lubricating oil and heavy diesel fuel.

16. The fuel injection pump of claim 15 wherein said flush connection passage includes a single annulus formed in said side surface of said plunger.

17. The fuel injection pump of claim 16 wherein said flushing fluid is a distillate oil.

18. The fuel injection pump of claim 17 wherein said flushing fluid inlet and said flushing fluid outlet share a common centerline where they open to said plunger bore;

said plunger bore has a plunger centerline; and said common centerline intersects said plunger centerline.

19. A fuel injection pump with precipitate inhibiting features comprising:

a pump body defining a flushing fluid inlet and a flushing fluid outlet that open into a plunger bore;

a plunger positioned in said plunger bore and being movable between a retracted position and an advanced position, and said plunger having a first end, which is exposed to lubricating oil, separated from a second end, which is exposed to heavy diesel fuel, by a side surface;

a portion of said side surface and said plunger bore defining a flush connection passage that connects said flushing fluid inlet to said flushing fluid outlet over an intermediate part of said plunger's movement between said retracted position and said advanced position;

a different portion of said side surface of said plunger blocking said flushing fluid inlet from said flushing fluid outlet over a beginning and ending part of said plunger's movement between said retracted position and said advanced position; and said flushing fluid inlet being connected to a source of flushing fluid that is different from said lubricating oil and said heavy diesel fuel.

20. The fuel injection pump of claim 19 wherein at least one of said flushing fluid inlet, said flushing fluid outlet and said flush connection passage including an annulus formed in said side surface of said plunger.

* * * * *